US012516676B2

(12) United States Patent
O'Grady et al.

(10) Patent No.: US 12,516,676 B2
(45) Date of Patent: Jan. 6, 2026

(54) INTERNAL ESP SEAL BAG SUPPORT

(71) Applicant: Baker Hughes Oilfield Operations LLC, Houston, TX (US)

(72) Inventors: Kenneth O'Grady, Owasso, OK (US); Mark Bellmyer, Broken Arrow, OK (US); Ryan Semple, Owasso, OK (US); Jeremy Van Dam, Edmond, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 113 days.

(21) Appl. No.: 18/386,530

(22) Filed: Nov. 2, 2023

(65) Prior Publication Data

US 2024/0141912 A1 May 2, 2024

Related U.S. Application Data

(60) Provisional application No. 63/421,711, filed on Nov. 2, 2022.

(51) Int. Cl.
*F04D 29/08* (2006.01)
*F04D 13/10* (2006.01)

(52) U.S. Cl.
CPC ..... *F04D 29/086* (2013.01); *F04D 13/10* (2013.01)

(58) Field of Classification Search
CPC ..... F04D 13/10; F04D 29/086; E21B 4/003; E21B 43/128
USPC ..... 277/331
See application file for complete search history.

(56) References Cited

U.S. PATENT DOCUMENTS

| | | | | |
|---|---|---|---|---|
| 3,209,785 | A | 10/1965 | Jean | |
| 8,246,052 | B1 | 8/2012 | Marvel | |
| 2011/0194956 | A1 | 8/2011 | Royzen | |
| 2016/0076550 | A1* | 3/2016 | Collins | F16J 15/002 277/336 |

OTHER PUBLICATIONS

ISA/US; International Search Report and Written Opinion for PCT/US2023/036710 mailed Apr. 9, 2024.

* cited by examiner

*Primary Examiner* — Kenneth J Hansen
(74) *Attorney, Agent, or Firm* — Baker Hughes Company

(57) ABSTRACT

A seal section for use in a downhole submersible pumping system includes a bag support tube, first and second bag support plates connected at opposite ends of the bag support tube, and a seal bag extending between the first and second bag support plates. The seal section further includes one or more seal bag shields inside the seal bag. The seal bag shields are configured to prevent the seal bag from becoming damaged through contact between the seal bag and the bag support tube or the first and second bag support plates.

9 Claims, 8 Drawing Sheets

INTERNAL ESP SEAL BAG SUPPORT

RELATED APPLICATIONS

This application claims the benefit of U.S. Provisional Patent Application Ser. No. 63/421,711 filed Nov. 2, 2022 entitled "Internal ESP Seal Bag Support," the disclosure of which is hereby incorporated by reference.

FIELD OF THE INVENTION

This invention relates generally to the field of submersible pumping systems, and more particularly, but not by way of limitation, to an improved seal section for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system must be engineered to withstand the inhospitable downhole environment, which includes wide ranges of temperature, pressure and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, protecting the motor from axial thrust imparted by the pump, and accommodating the expansion and contraction of the dielectric motor lubricant as the motor moves through thermal cycles during operation. Many seal sections employ seal bags to accommodate the volumetric changes and movement of fluid in the seal section. Seal bags can also be configured to provide a positive barrier between clean lubricant and contaminated wellbore fluid.

Modern seal bags are often manufactured from advanced polymers, like perfluoroalkoxy alkane (PFA), which is a transparent copolymer of tetrafluoroethylene and perfluoroalkyl vinyl ether. Although generally effective for many applications, repetitive thermal and volumetric cycling can damage the polymer seal bag, particularly if the contraction of the seal bag causes the seal bag to fold or contact metal edges within the seal section. For example, if the seal bag collapses into the exchange ports within the seal bag support tube, the contact with the metal edges around the exchange ports can abrade the seal bag, thereby compromising its structural integrity. There is, therefore, a need for an improved seal section that mitigates against the potential damage caused to seal bags from repetitive cycling and contact with metal parts inside the seal section. It is to this and other needs that the disclosed embodiments are directed

SUMMARY OF THE INVENTION

In some embodiments, the present disclosure is directed to a seal section for use in a downhole submersible pumping system. The seal section includes a bag support tube, first and second bag support plates connected at opposite ends of the bag support tube, and a seal bag extending between the first and second bag support plates. The seal section further includes one or more seal bag shields inside the seal bag. The seal bag shields are configured to prevent the seal bag from becoming damaged through contact between the seal bag and the bag support tube or the first and second bag support plates.

In other embodiments, the present disclosure is directed to a seal section usable in a downhole submersible pumping system, where the seal section includes a seal bag inside the seal section, where the seal bag has a seal bag interior. The seal section includes a seal bag shield inside the seal bag interior. The seal bag shield can include one or more lobes to protect the seal bag as it collapses around the seal bag shield.

In yet other embodiments, the present disclosure is directed to a seal section usable in a downhole submersible pumping system. In these embodiments, the seal section has a bag support tube, first and second bag support plates connected at opposite ends of the bag support tube, a seal bag extending between the first and second bag support plates, and a seal bag shield inside the seal bag. The seal bag shield can include a first support rod base, a second support rod base, and a plurality of support rods each extending between the first support rod base and the second support rod base. The plurality of support rods can each be connected within the first and second support rod bases at a contoured interface.

WRITTEN DESCRIPTION

Figure 1:
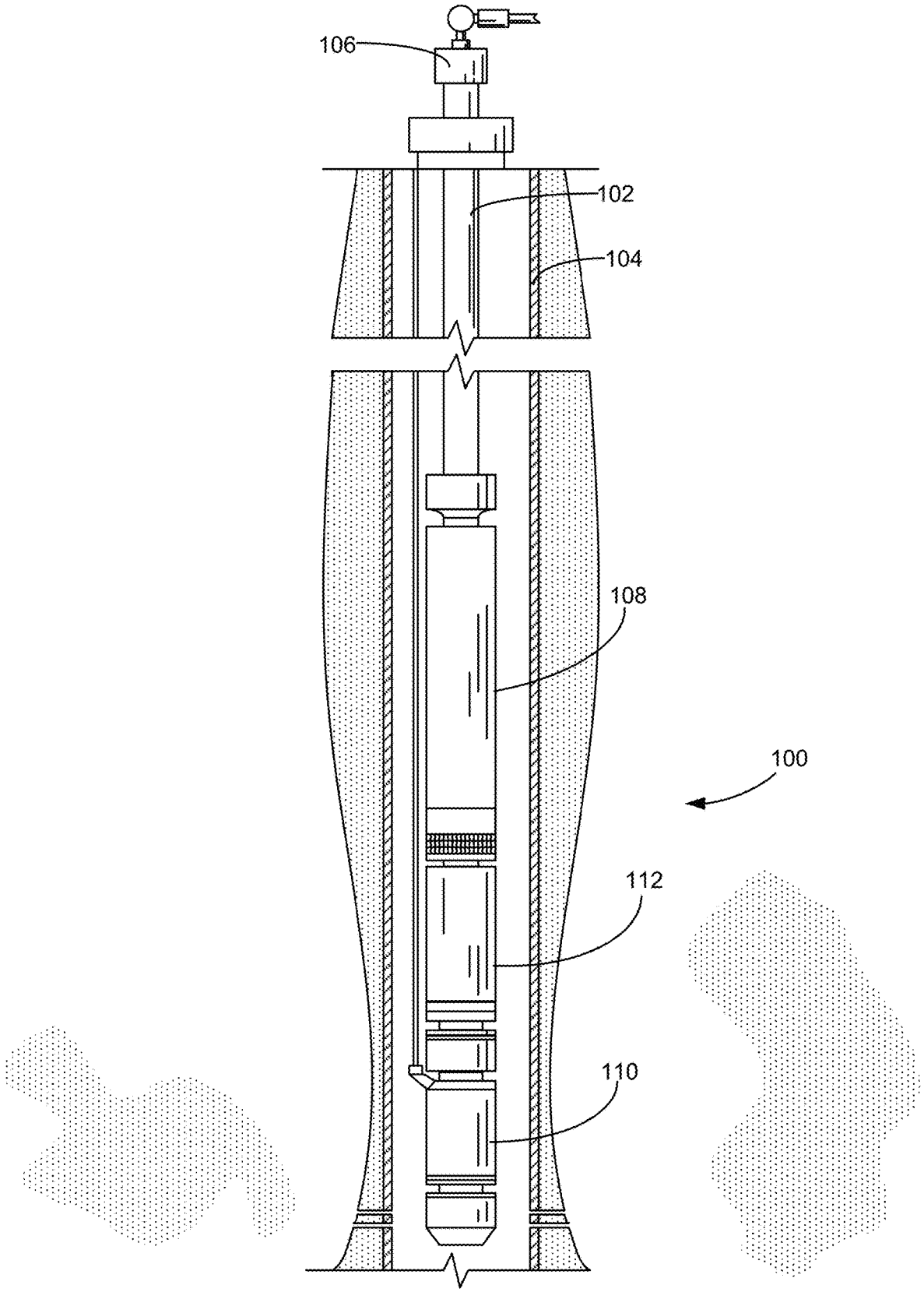
FIG. 1 is a front elevational view of a downhole pumping system.

In accordance with exemplary embodiments of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas.

As depicted in FIG. 1, the pumping system 100 includes a pump 108, a motor 110, and a seal section 112. The production or coiled tubing 102 connects the pumping system 100 to a wellhead 106 located on the surface (which may be an onshore well pad or an offshore production platform). Although the pumping system 100 is primarily designed to pump petroleum products, it will be understood that the present invention can also be used to move other fluids.

The motor 110 receives power from a surface-based facility through one or more power cables. Generally, the motor 110 is configured to drive the pump 108. In some embodiments, the pump 108 is a turbomachine that uses one or more impellers and diffusers to convert mechanical energy into pressure head. In alternate embodiments, the pump 108 is configured as a positive displacement pump. The pump 108 transfers a portion of this mechanical energy to fluids within the wellbore 104, causing the wellbore fluids to move through the production tubing 102 to the surface.

The seal section 112 shields the motor 110 from mechanical thrust produced by the pump 108. The seal section 112 is also configured to prevent the introduction of contaminants from the wellbore 104 into the motor 110. Although only one pump 108, seal section 112 and motor 110 are shown, it will be understood that the downhole pumping system 100 could include additional pumps 108, seals sections 112 or motors 110.

Figure 2:
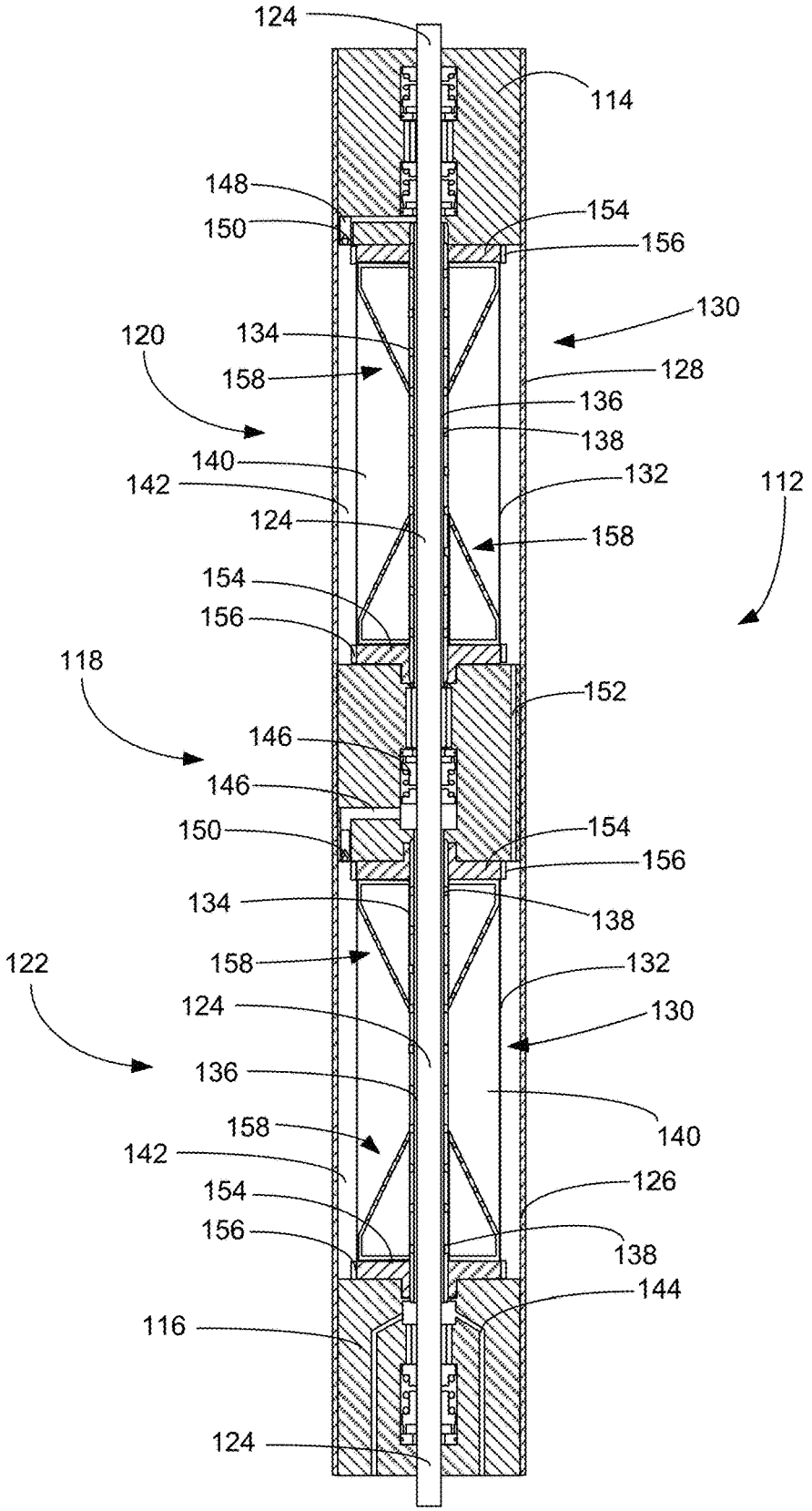
FIG. 2 is an elevational view of a seal section constructed of the pumping system of FIG. 1.

Referring now to FIG. 2, shown therein is an elevational and cross-sectional view of the seal section 112. The seal section 112 includes a head 114, a base 116 and an intermediate guide 118. The intermediate guide 118 separates an upper chamber 120 from a lower chamber 122. The head 114 is configured for connection to the pump 108 and the base 116 is configured for connection to the motor 110. Although the seal section 112 depicted in FIG. 2 includes an upper chamber 120 and a lower chamber 122, it will be appreciated that in other embodiments, the seal section 112 can a include a single chamber without the intermediate guide 118, or additional chambers with additional intermediate guides 118. The seal section 112 includes a shaft 124 that extends through the seal section 112 to deliver torque from the motor 110 to the pump 108.

In the embodiment depicted in FIG. 2, the lower chamber 122 includes a lower chamber housing 126 that is configured for a threaded connection between the intermediate guide 118 and the base 116. Similarly, the upper chamber 120 includes an upper chamber housing 128 that is configured for a threaded connection between the intermediate guide 118 and the head 114. In both cases, the upper chamber housing 128 and the lower chamber housing 126 include separation mechanisms designed to prevent wellbore fluids from contaminating lubricants in the motor 110.

In the embodiment depicted in FIG. 2, the upper and lower chambers 120, 122 both include a seal bag assembly 130 that includes a seal bag 132 and a bag support or guide tube 134, which surrounds the shaft 124. The bag support tube 134 defines an inner annular space 136 between the bag support tube 134 and the shaft 124. The bag support tube 134 includes one or more bag ports 138 that communicate fluid between the inner annular space 136 and a seal bag interior 140 within the seal bag 132. The seal bag 132 separates the seal bag interior 140 from an outer chamber space 142 between the exterior of the seal bag 132 and the upper and lower housings 128, 126.

The inner annular space 136 is in fluid communication with motor lubricant in the motor 110 through one or more lubricant channels 144 that extend through the base 116 to the motor 110. In this way, motor lubricant expanding from the motor 110 is directed through the lubricant channels 144 into the seal bag interior 140 through the inner annular space 136 of the bag support tube 134. The movement of motor lubricant out of the seal bag 132 is confined within the inner annular space 136 until it reaches the intermediate guide 118. There, an intermediate shaft seal 146 diverts the motor oil through a return port 148 to the outer chamber space 142. The return port 148 optionally includes a return check valve 150 to prevent the reverse flow of fluid from the outer chamber space 142 through the return port 148. The return port 148 and return check valve 150 protect the seal bag 132 from an over-pressure condition by allowing excessive fluid pressure in the seal bag interior 140 to be released into the outer chamber space 142. The intermediate guide section 118 also includes an intermediate passage 152 that connects the outer chamber spaces 142 within the upper and lower chambers 120, 122.

The seal bags 132 are generally configured as open-ended cylinders that are secured on each end between a bag support plate 154 and a locking collar 156. The first and second bag support plates 154 are connected on opposite ends of the bag support tube 134. In some embodiments, the seal bag 132 is fabricated from one or more fluoroelastomers such as AFLAS (tetrafluoroethylene/propylene) or PFA (perflouroalkoxy), which are commercially available from a number of sources.

Figure 3A:
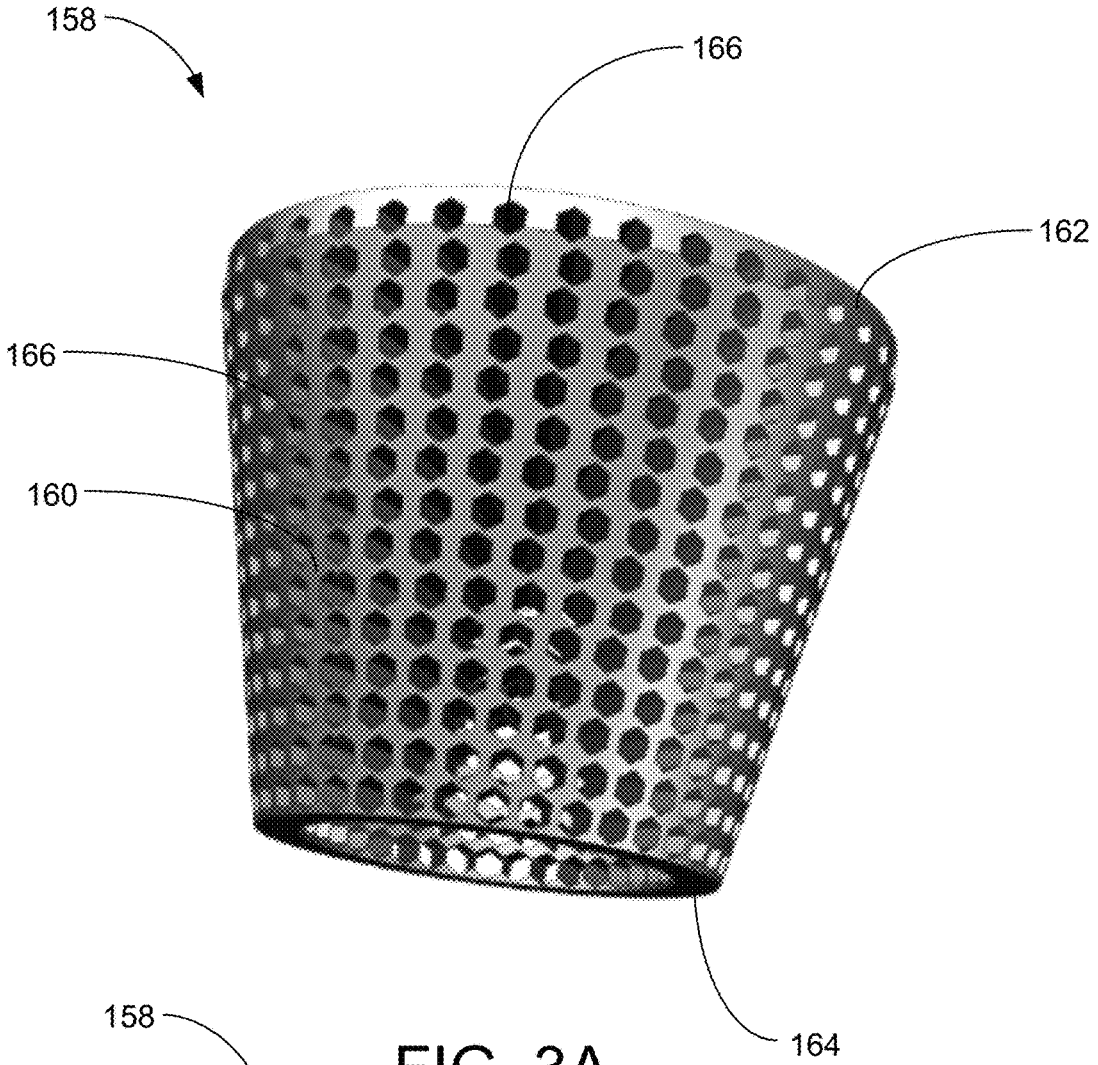
FIGS. 3A-3F present views of seal bag shields constructed in accordance with exemplary embodiments.

To prevent damage to the seal bag 132, the seal bag assembly 130 further includes one or more seal bag shields 158. Embodiments of the seal bag shield 158 are shown in isolation in FIGS. 3A-3F. FIG. 3A presents a perspective view of an embodiment in which the seal bag shield 158 has a generally frustoconical body 160 that tapers from an outboard end 162 to an inboard end 164. In some embodiments, the base 158 includes a cylindrical section that transitions to the frustoconical form.

Figure 3B:
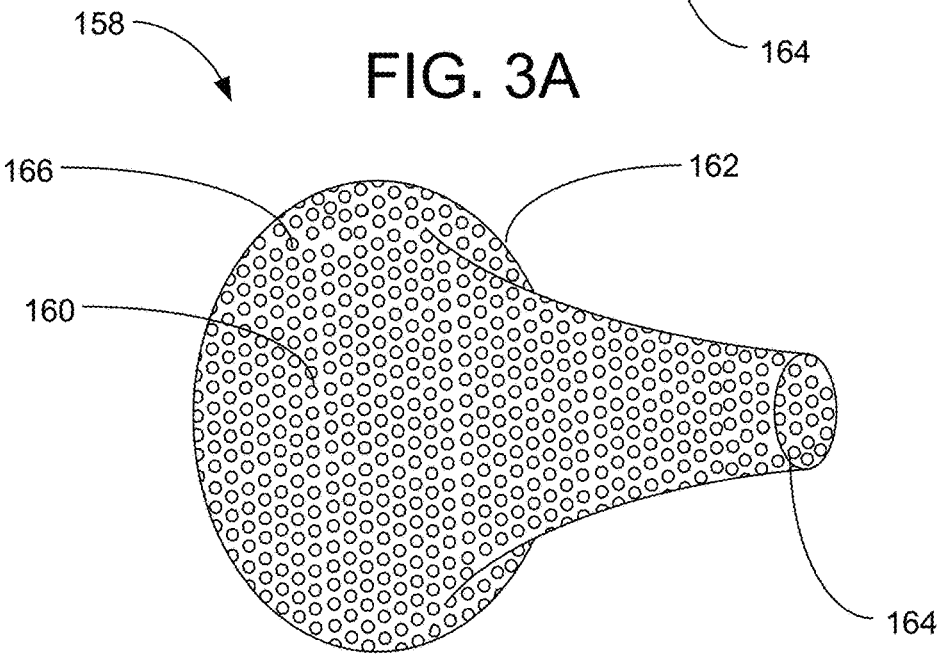

In the embodiment depicted in FIG. 3B, the body 160 of the seal bag shield 158 is characterized by a curved outer surface that could be formed by the revolution of an arcuate curve about the longitudinal axis extending through the center of the seal bag shield 158. In both embodiments, the surface of the seal bag shield 158 includes one or more holes 166, which permit the exchange of fluid across the seal bag shield body 160. In the embodiment depicted in FIG. 3B, the seal bag shield 158 includes a large number of holes 166 such that the seal bag shield body 160 presents a perforated appearance. The seal bag shield 158 can be constructed from a suitable metal, mesh, plastic or other composite material using molding, machining or additive manufacturing processes.

Figure 3C:
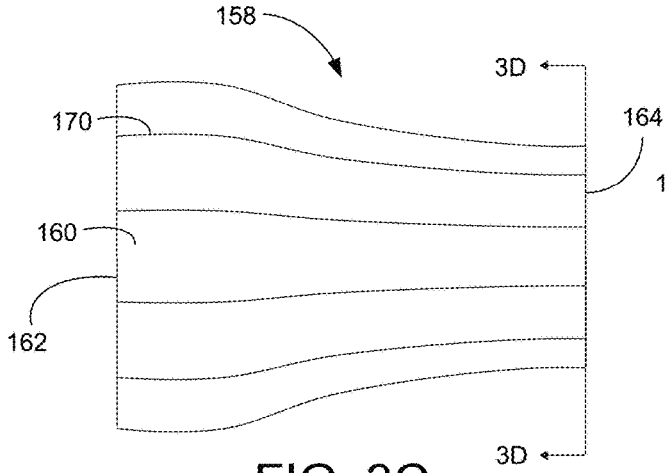
Figure 3D:
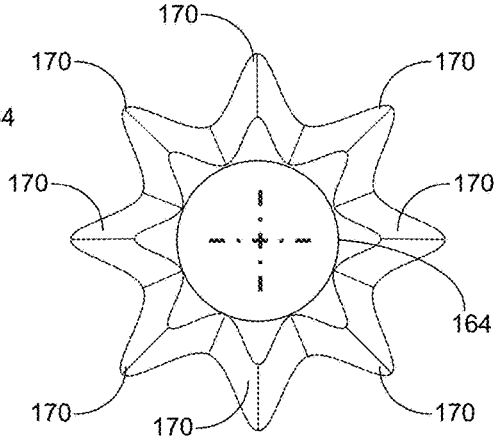

FIGS. 3C and 3D present side and end views, respectively, of an embodiment of the seal bag shield 158 in which the seal bag shield body 160 includes a plurality of lobes 170 that extend radially outward and longitudinally along the tapered, contoured length of the seal bag shield body. The lobes 170 have a smaller outer diameter on the inboard end 164 of the seal bag shield body 160 than on the outboard end 162 of the seal bag shield body 160. Although eight lobes 170 are depicted in FIGS. 3C-3F, it will be appreciated that fewer or greater numbers of lobes 170 are also contemplated as within the scope of these embodiments. For example, in some embodiments, the seal bag shield 158 includes one, two, three, four, five, six, seven, eight, nine, or ten or more lobes 170, which may be of common or different radial heights, and of equidistant or varied spacing around the central longitudinal axis extending through the seal bag 132.

Figure 3E:
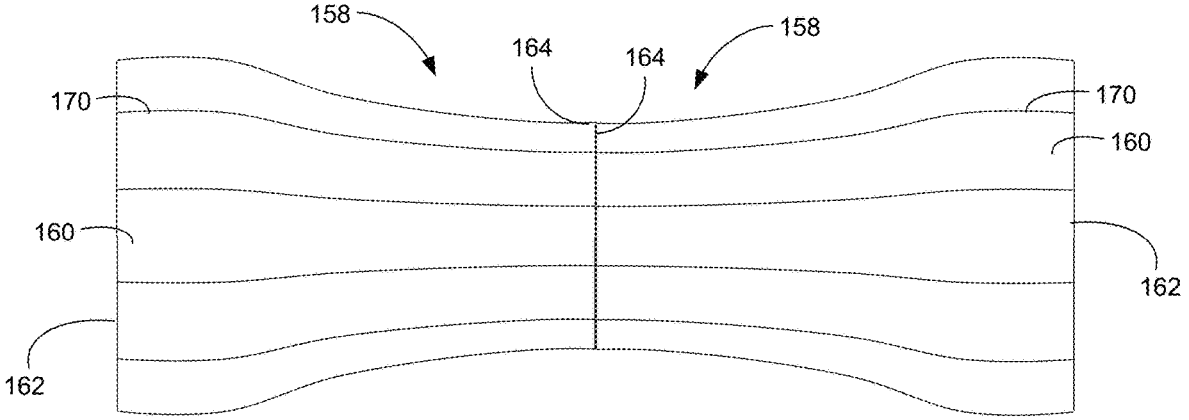
Figure 3F:
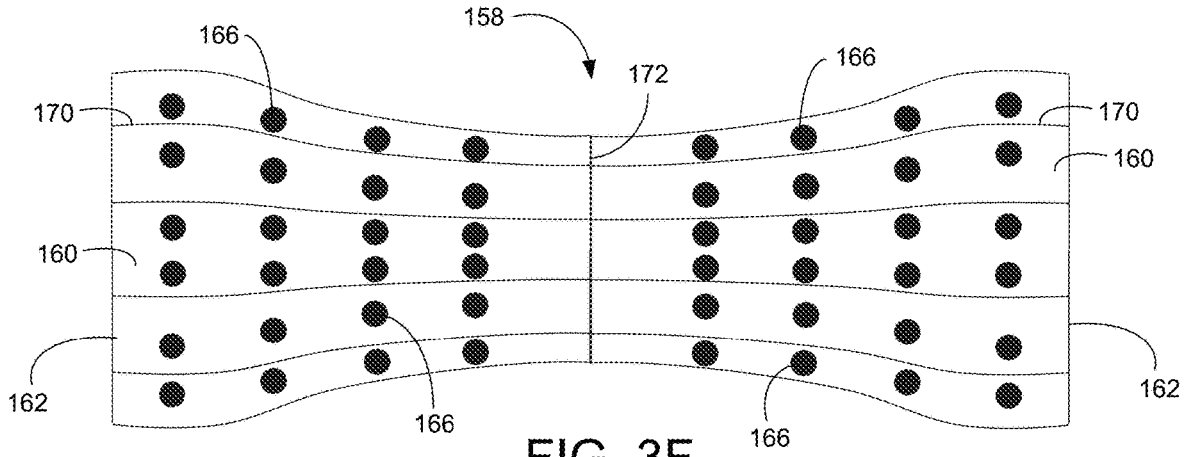

In the embodiment depicted in FIG. 3E, two seal bag shields 158 are arranged in an end-to-end relationship such that the inboard ends 164 are connected or located in positions adjacent to one another. In other embodiments as depicted in FIG. 3F, the seal bag shield body 160 of a single seal bag shield 158 tapers from opposing first and second outboard ends 162 with lobes 170 having respective first and second outer diameters to a common central portion 172 with lobes 170 having inboard outer diameters that are smaller than the first and second outer diameters.

In the embodiments depicted in FIGS. 3C-3E, the seal bag shield body 160 is constructed from a permeable mesh material that permits the exchange of fluid across the seal bag shield body 160. In the embodiment depicted in FIG. 3F, the seal bag shield body 160 may be constructed from an impermeable material that includes a plurality of holes 166 to permit the movement of fluid across the seal bag shield 158. In each case, the lobes 170 provide support to the seal bag 132 to prevent the seal bag 132 from collapsing in an uneven manner in which one or more portions of the seal bag 132 collapse that would apply more stress to certain parts of the seal bag 132.

As shown in FIG. 2, each seal bag shield 158 is connected within the seal bag interior 140 to the bag support tube 134, the bag support plate 154, or to both the bag support tube 134 and the bag support plate 154. The outboard end 162 of the seal bag shield 158 is oriented against the bag support plate 154, with the tapered end 164 of the seal bag shield 158 in contact or proximity to the bag support tube 134. In some embodiments, the seal bag shield 158 is integrated into the bag support tube 134. In some embodiments, the seal bag shield 158 is integrated into the bag support plate 154.

In this way, fluids exchanged through the bag ports 138 in the bag support tube 134 are permitted to pass through the holes 166 of the seal bag shield 158 into the seal bag interior 140. In the embodiment depicted in FIG. 2, the seal section 112 includes an upper and a lower seal bag shield 158 in each seal bag assembly 130. It will be appreciated, however, that in certain embodiments, one or more of the seal bag assemblies 130 may include a single seal bag shield 158 or no seal bag shields 158.

Figure 4:
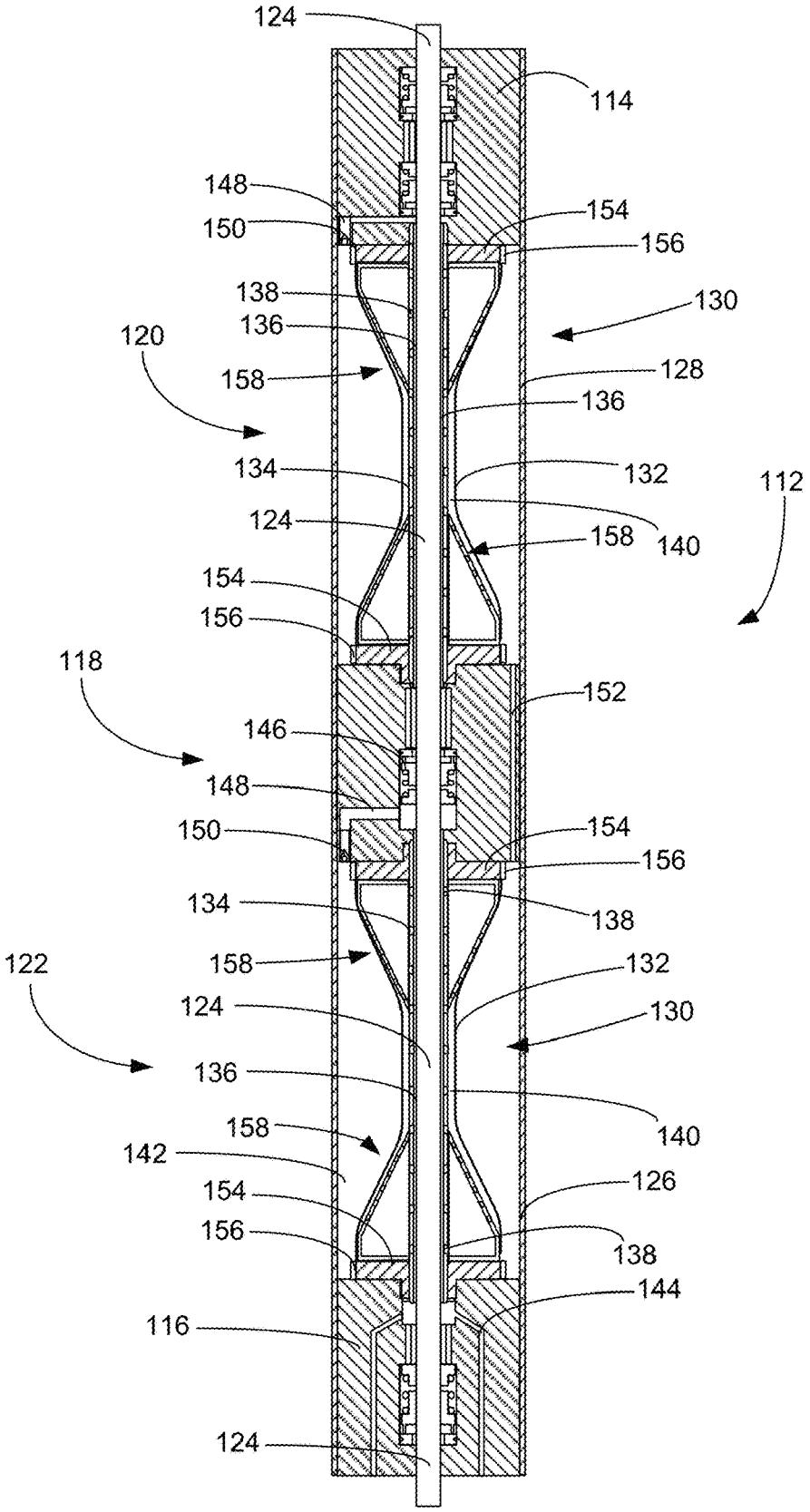
FIG. 4 depicts the seal section of FIG. 2 in a state in which the seal bags have collapsed around the seal bag shield.

As the pumping system 100 operates and undergoes thermal cycling, the motor oil may expand and inflate the seal bags 132. As the motor 110 cools and the motor oil contracts, the seal bags 132 may collapse within the upper and lower chambers 120, 122, as depicted in FIG. 4. As the seal bags 132 collapse, the seal bags 132 are pulled into contact with the seal bag shields 158, which prevent the seal bags 132 from being pulled into the bag ports 138, abrading through contact with the bag support plates 154, or deforming to such an extent that the seal bags 132 are damaged. In this way, the seal bag shields 158 provide an interior guard that reduces the risk of damage as the seal bags 132 contract within the seal section 112.

Figure 5:
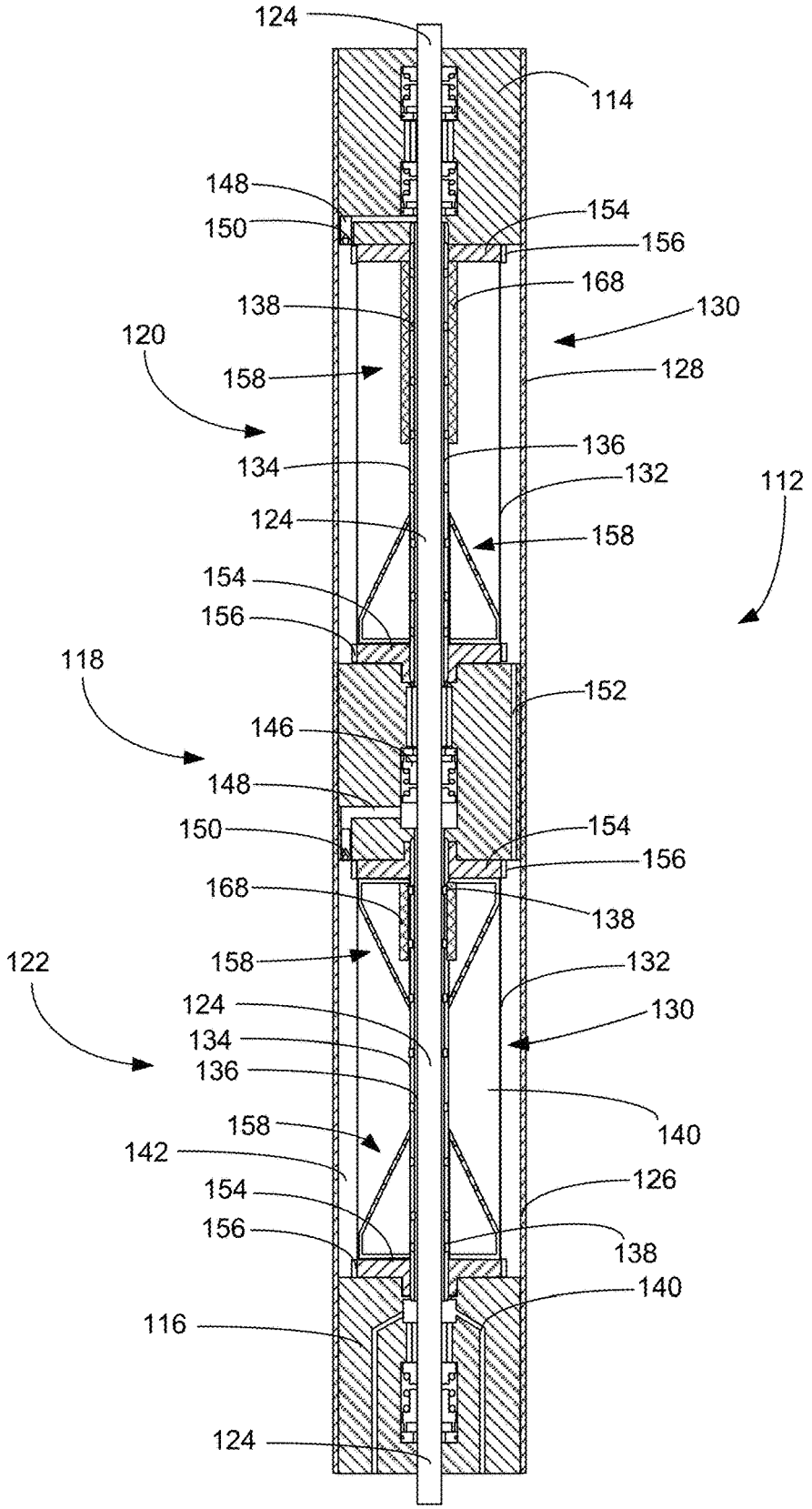
FIG. 5 depicts a seal section in which mesh cylinders have been used to cover a portion of the bag support tube and bag ports.

As depicted in FIG. 5, one or more cylindrical mesh guards 168 can be included around the outside of the bag support tube 134 to prevent the seal bag 132 from being drawn into the bag ports 138. The mesh guards 168 can be used in addition to, or in place of, the seal bag shields 158. The mesh guards 168 can be secured to the bag support tube 134 with clamps or other fasteners.

Figure 6A:
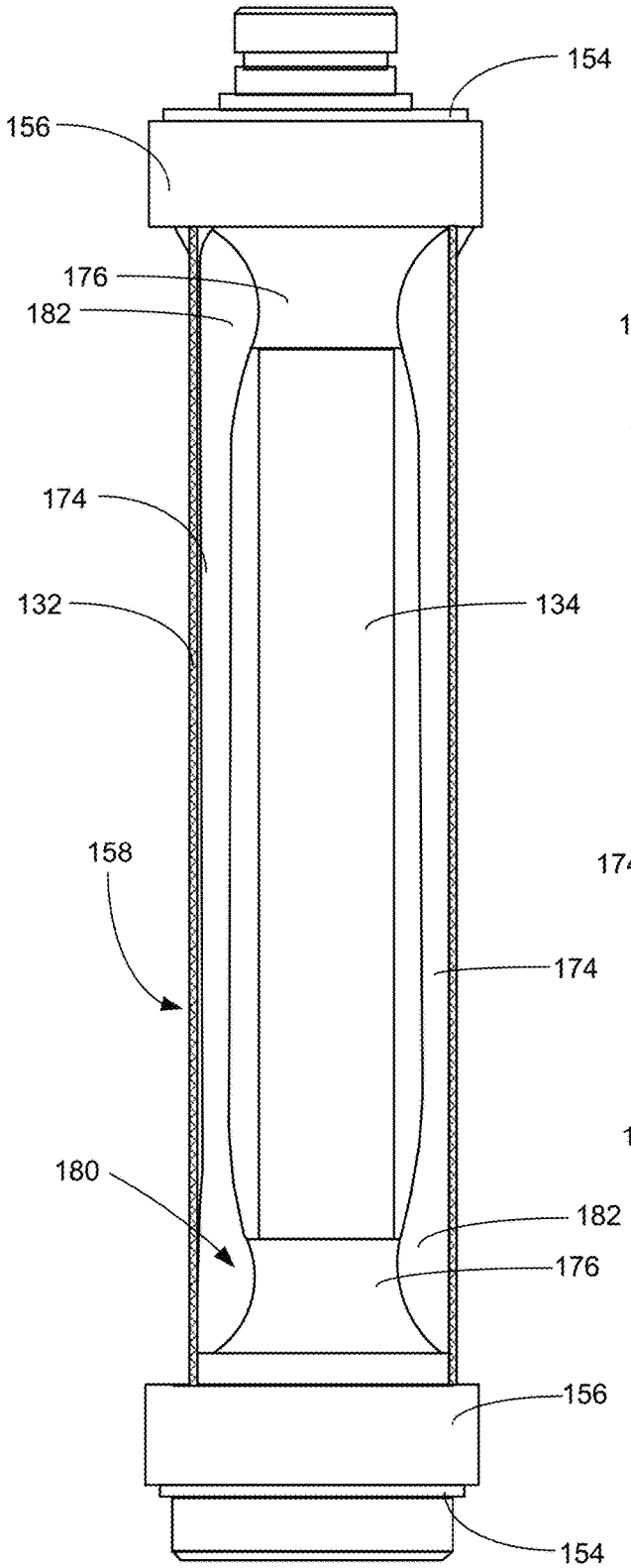
FIGS. 6A-6B depict an embodiment in which the seal bag shield includes a plurality of support rods captured between contoured rod bases.
Figure 6B:
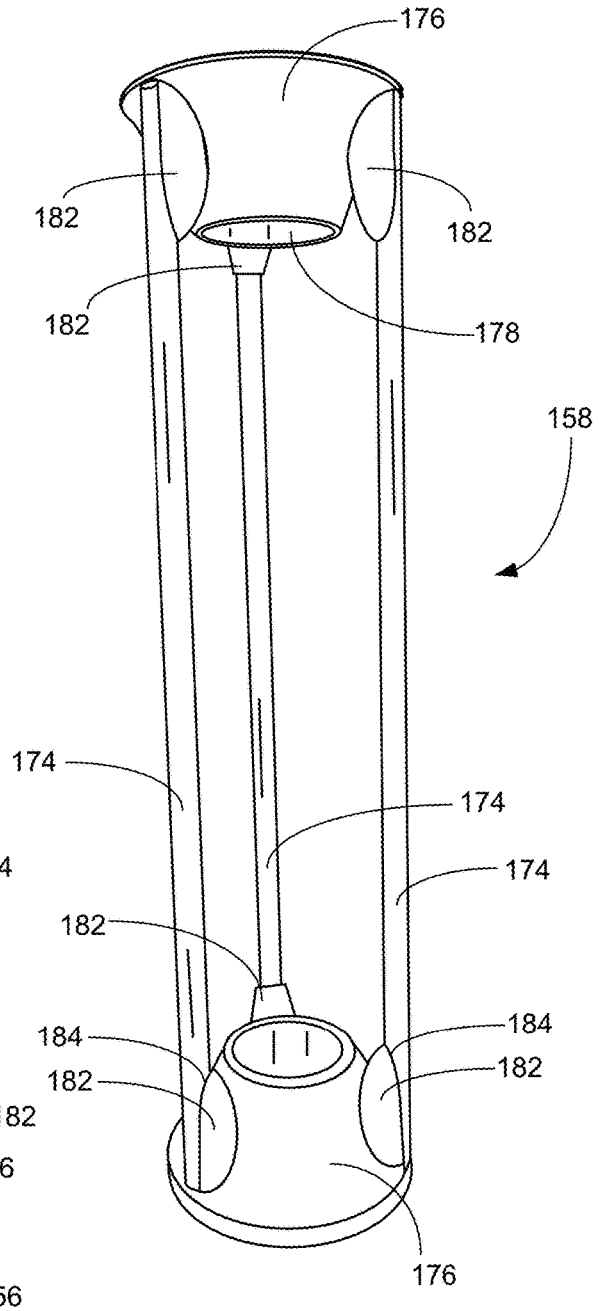
Figure 7:
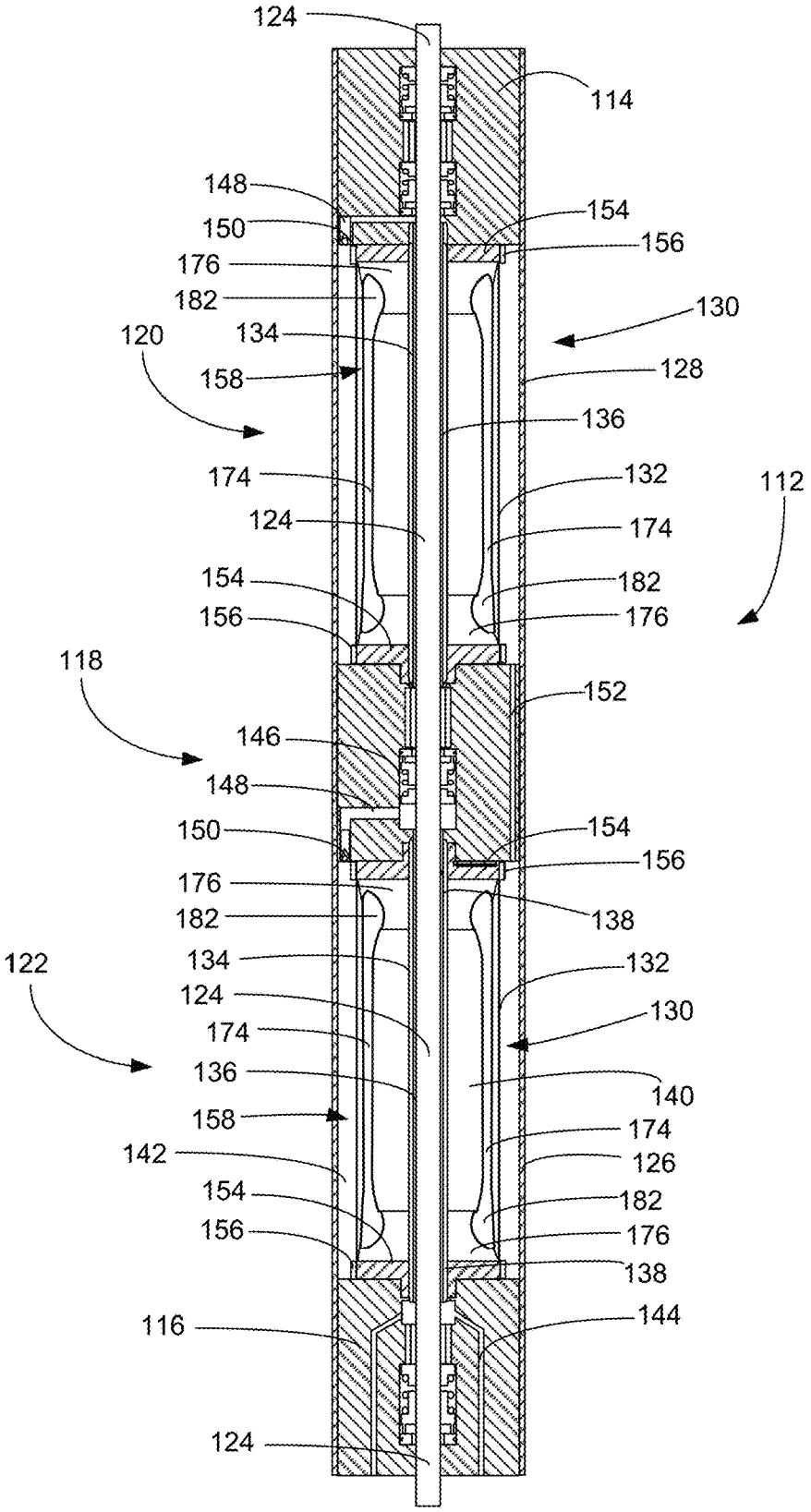
FIG. 7 depicts the incorporation of the support rods and contoured rod bases into the seal section of FIG. 2.

Turning to FIGS. 6A and 6B, shown therein are side and perspective views of an embodiment of the seal bag shield 158 that includes a plurality of bag support rods 174 that are captured between support rod bases 176. The seal bag shield 158 is shown in isolation in FIG. 6B, without the seal bag 132, bag support tube 134, bag support plates 154 and locking collar 156. The support rod bases 176 are generally configured as rounded cones with a bag support tube aperture 178 sized and configured to accept the bag support tube 134. The bag support rods 174 extend between the opposing support rod bases 176. As best illustrated in FIG. 6B, the seal bag shield 158 includes three bag support rods 174 that are spaced apart from one another at substantially equal distances or by about 120° around the outer circumference of the support rod bases 176. In other embodiments, the seal bag shield 158 can include two bag support rods 174 or four or more bag support rods 174.

Importantly, each bag support rod 174 intersects the support rod bases 176 with contoured interfaces 180. The contoured interfaces 180 are designed to eliminate or reduce any sharp or straight-line edges or voids between the bag support rods 174 and the support rod bases 176. The contoured interfaces 180 can include a bulbous prominence 182 that extends between the surface of the conical support rod base 176 and the end of the bag support rod 174. The bulbous prominence 182 can approximate a capsule-shape that has been truncated between the conical outer surface of the support rod base 176 and the generally cylindrical shape of the bag support rods 174.

In some embodiments, the bulbous prominence 182 is integral with the bag support rod 174 (as depicted in FIG. 6A), while in other embodiments the bulbous prominence 182 is integral with the support rod base 176 (as depicted in FIG. 6B). In each case, the bag support rods 174 can be configured with rounded, oval or oblong and variable cross-sectional shape and the bag support rods 174 can be straight or curved (concave or convex) along the length between the opposing support rod bases 176. The bag support rods 174 can be rigid to resist inward deformation as the seal bag 132 collapses under reduced pressure. In some embodiments, the support rod bases 176 are manufactured through an additive manufacturing process using composites, metals or plastics to accommodate the complex geometry of the support rod bases 176.

In some embodiments, the bag support rods 174 are secured within the support rod base 176 using interference fit clips 184. The interference fit clips 184 can be integrated into the support rod base 176 and configured as a recess with a partially open diameter that is slightly smaller than the outer diameter of the end of the bag support rod 174. In this way, the bag support rod 174 can be secured into the support rod base 176 by forcing the end of the bag support rod 174 into the interference fit clip 184, which then closes and captures the bag support rod 174 in a fixed position relative to the support rod base 176.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section usable in a downhole submersible pumping system, the seal section comprising:

a bag support tube;

first and second bag support plates connected at opposite ends of the bag support tube;

a seal bag extending between the first and second bag support plates; and a first seal bag shield inside the seal bag, wherein the first seal bag shield comprises:

a first bag support base;

a second bag support base; and a plurality of bag support rods each extending between the first bag support base and the second bag support base.

2. The seal section of claim 1, wherein the first seal bag shield comprises a contoured interface between each of the plurality of bag support rods and the first and second bag support bases.

3. The seal section of claim 2, wherein each contoured interface comprises a bulbous prominence between the bag support rod and the corresponding support rod base.

4. A seal section usable in a downhole submersible pumping system, the seal section comprising:

a bag support tube;

first and second bag support plates connected at opposite ends of the bag support tube;

a seal bag extending between the first and second bag support plates; and a first seal bag shield inside the seal bag, wherein the first seal bag shield is connected to the bag support tube and wherein the first seal bag shield comprises a frustoconical body that includes a plurality of holes.

5. The seal section of claim 4, wherein the first seal bag shield comprises a base in proximity or contact with the first bag support plate.

6. The seal section of claim 5, wherein the first seal bag shield comprises a tapered end in proximity or contact with the bag support tube.

7. A seal section usable in a downhole submersible pumping system, the seal section comprising:

a bag support tube;

first and second bag support plates connected at opposite ends of the bag support tube;

a seal bag extending between the first and second bag support plates;

a first seal bag shield inside the seal bag;

a second seal bag shield within the seal bag, wherein the second seal bag shield comprises a base in proximity or contact with the second bag support plate, and wherein the second seal bag shield comprises a frustoconical seal bag shield body that is perforated with a plurality of holes.

8. A seal section usable in a downhole submersible pumping system, the seal section comprising:

a seal bag inside the seal section, wherein the seal bag comprises a seal bag interior; and a seal bag shield within the seal bag interior, wherein the seal bag shield comprises:

a seal bag shield body that tapers from opposing first and second outboard ends with lobes having first and second outer diameters to a central portion with lobes with an inboard outer diameter that is smaller than the first and second outer diameters.

9. A seal section usable in a downhole submersible pumping system, the seal section comprising:

a bag support tube;

first and second bag support plates connected at opposite ends of the bag support tube;

a seal bag extending between the first and second bag support plates; and a seal bag shield inside the seal bag, wherein the seal bag shield comprises:

a first support rod base;

a second support rod base;

a plurality of support rods each extending between the first support rod base and the second support rod base; and means for securing each of the plurality of support rods within the first and second support rod bases at a contoured interface.

* * * * *